US005831579A

United States Patent [19]

Rudisill

[11] Patent Number: 5,831,579

[45] Date of Patent: Nov. 3, 1998

[54] LATCH MECHANISM FOR MOBILE COMMUNICATION DEVICES

[75] Inventor: Charles Albert Rudisill, Apex, N.C.

[73] Assignee: Ericsson, Inc., Research Triangle Park, N.C.

[21] Appl. No.: 834,287

[22] Filed: Apr. 15, 1997

[51] Int. Cl.[6] ..... H01Q 1/24; H01Q 1/12; H01Q 1/10

[52] U.S. Cl. ..... 343/702; 343/702; 343/899; 343/900; 343/901; 343/915; 343/903

[58] Field of Search ..... 343/702, 889, 343/900, 715, 877, 901, 903; H01Q 1/24, 1/12, 1/10

[56] References Cited

U.S. PATENT DOCUMENTS

| | | | |
|---|---|---|---|
| 4,725,845 | 2/1988 | Phillips | 343/702 |
| 4,834,672 | 5/1989 | Michely | 439/471 |
| 5,524,284 | 6/1996 | Marcou et al. | 455/90 |
| 5,714,958 | 2/1998 | Rudisill | 343/702 |
| 5,748,150 | 5/1998 | Rudisill | 343/702 |

FOREIGN PATENT DOCUMENTS

| | | | |
|---|---|---|---|
| 405235623A | 9/1993 | Japan | H01Q 1/24 |

*Primary Examiner*—Frank G. Font
*Assistant Examiner*—Layla G. Lauchman
*Attorney, Agent, or Firm*—Jenkens & Gilchrist, P.C.

[57] ABSTRACT

A latch mechanism for a cellular phone includes a rotatable detent portion attached to the helix of the antenna. A fixed detent member permanently attached to the phone includes a passageway to allow the antenna and rotatable detent to pass therethrough. A biased teeth is mounted between a plurality of guide detents formed on the inner surface within the fixed detent member and the base of the phone. While the teeth ring is allowed to move axially, it is keyed to prevent rotation. Accordingly, the detents formed on the rotatable detent member cause the rotatable detent member to rotate as it passes between the guide detents and as it engages the teeth ring. The forced rotations cause the detents of the rotatable detent portion to become engaged and disengaged with a latching undercut portion formed on a bottom portion of the guide detents.

11 Claims, 8 Drawing Sheets

LATCH MECHANISM FOR MOBILE COMMUNICATION DEVICES

BACKGROUND OF THE INVENTION

1. Technical Field of the Invention

The present invention relates to mobile communication devices, and, in particular, to antenna latch mechanisms for mobile communication devices.

2. Description of Related Art

Latch mechanisms frequently employ separate parts or components such as buttons and springs that must be installed separately into the housing of a communication device such as a cellular phone. This is especially true for antennas which employ a "push-push" type of system for automatically extending antennas.

Portable communication devices, and cellular phones in particular, are continuously being reduced in size. The need to simplify the antenna operation and to reduce the number of parts and the amount of space required to house the parts frequently motivates designers to avoid push-push latch mechanisms. Consequently, push-push types of latching mechanisms often are not used. Cellular phones, therefore, typically utilize antenna systems which require manual placement into the extended or retracted positions. While manually-operable antennas reduce complexity, however, they also are less convenient from the user's perspective.

More specifically, many cellular phones and other communication devices contain a retractable "whip" type of antenna. While it is possible to make such antennas extend automatically by incorporating a driving mechanism such as a clock/motor spring, constant-force spring, or long compression spring, known latch mechanisms for automatically extending antennas complicate the antenna systems to a point that it is preferable to implement a manually retractable system. Automatically extending antennas are otherwise desirable because they are convenient. There is a need therefore, for a latching mechanism which is low cost and simple, which is self-contained within the antenna assembly, which does not require additional buttons or springs in the telephone housing and which may be interchanged with different models of phones so that automatically extending antennas may be incorporated into portable communication devices more readily.

SUMMARY OF THE INVENTION

A latch mechanism is provided which employs a simple push-push type design that does not require additional buttons or springs so that an automatically extending type of antenna mechanism may readily be employed within communication devices such as cellular phones.

More specifically, a spring loaded antenna includes a detent portion which is free to rotate about the antenna axis. The detent portion includes a plurality of detents formed with specially angled surfaces for engaging a plurality of guide surfaces formed upon a biased teeth ring and also formed upon a plurality of stationary detents formed within a fixed detent assembly. Each of the stationary detents within the fixed detent assembly includes an undercut portion for engagedly holding the detents of rotatable detent portions. The specially angled surfaces of the detents of the detent portion cause the detent portion to rotate about the antenna axis into and out of an engaged position as the antenna is repeatedly pushed with a finger. Accordingly, if the antenna is locked in place because the detents of the detent portion are engaged with a latching undercut portion of the fixed detents of the fixed detent assembly, a downward push of the antenna causes the spring loaded teeth ring to interact with the detents of the detent portion and causes the detent portion to rotate to an unengaged position wherein the spring loaded antenna is urged outward by its spring to an extended position.

Similarly, if an extended antenna is urged by a finger downward and into the mobile communication device, the specially angled surfaces of the detents engage the stationary detent to cause the detent member to rotate to a radial position wherein the detents may freely move through a plurality of channel portions defined by the spacing between the fixed detents until the detents engage the teeth ring. As the detents engage the teeth ring, the detent member rotates to a position wherein the detents become engaged, again, within the latching undercut of the fixed detents whenever the finger releases the antenna and ceases to urge it in a downward direction. When the finger ceases to urge the antenna into the communication device, the spring loaded antenna is urged outward until the detents of the detent portion become engaged with the undercut portions. Accordingly, the antenna may be latched into place or unlatched with a mere push of the finger.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE DRAWINGS

Figure 1:
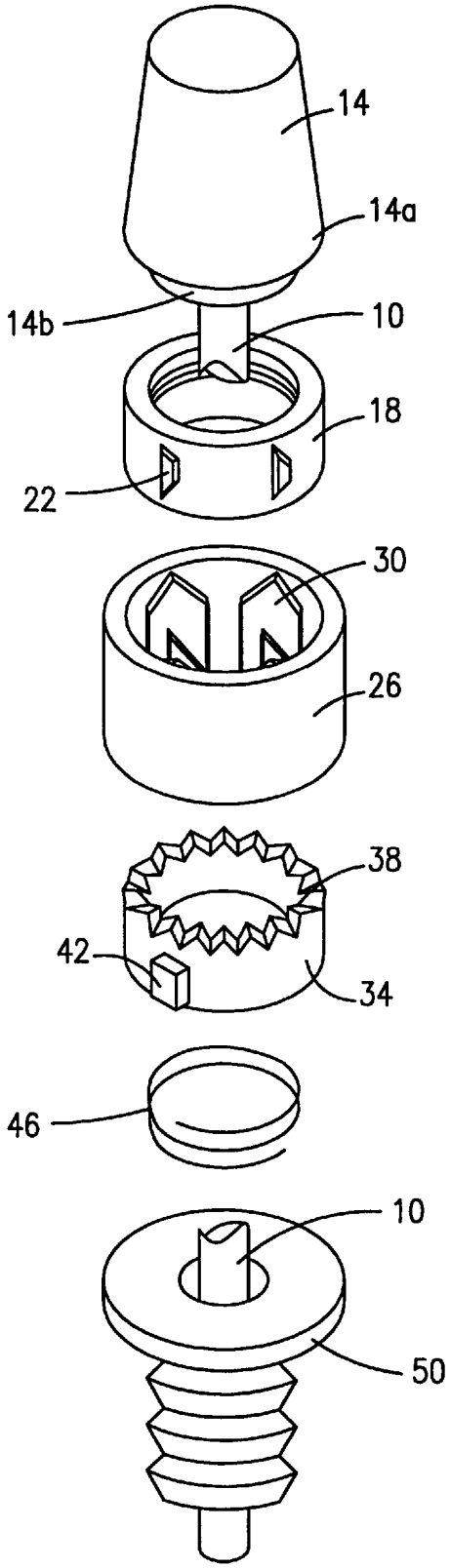
FIG. 1 is an exploded perspective view of an antenna and a push-push latch mechanism according to a preferred embodiment of the invention.

FIG. 1 is an exploded perspective view of an antenna and a push-push latch mechanism according to a preferred embodiment of the invention. Referring now to FIG. 1, a whip antenna 10 includes a helix 14 permanently attached thereto at a top end of antenna 10. The helix 14 includes a top portion 14*a* and a bottom portion 14*b*. The bottom portion 14*b* is recessed in relation to upper portion 14*a* and, accordingly, has a smaller diameter.

The antenna and latch mechanism of FIG. 1 also includes a movable detent member 18 that is rotatably attached to helix 14. In the preferred embodiment, detent member 18 is rotatably attached to bottom portion 14*b* of helix 14. A plurality of detents 22 are formed on detent member 18.

Continuing to refer to FIG. 1, the latch mechanism includes a fixed detent member 26 having an inner surface forming a passage way therewithin. A plurality of guide surfaces 30 are formed thereon the inner surface. The guide surfaces 30 are formed in a manner to matingly engage the detents 22 of detent member 18. In the preferred embodiment, fixed detent member 26 is rigidly and permanently attached to the housing of a communication device (not shown explicitly in FIG. 1).

A biasing teeth ring 34 includes a plurality of teeth 38. The teeth 38 of teeth ring 34 are formed to matingly engage with the detents 22 of detent member 18. Generally, teeth ring 34 is not permanently attached to any structure and is allowed to move freely. To prevent rotation and to only allow movement in a vertical direction, however, teeth ring 34 includes a notch portion 42 formed to matingly fit within a vertically oriented channel (not shown in FIG. 1) formed within an inner surface of fixed detent member 26. Also shown in FIG. 1 is a biasing device 46 which is placed between teeth ring 34 and a base 50. Each of detent member 18, fixed detent member 26, teeth ring 34, biasing device 46 and base 50 include a tunnel portion to allow whip antenna 10 to pass therethrough. The base 50 also is permanently attached to the communication device. The base 50 is for creating a solid foundation from which the biasing device 50 urges teeth ring 34 in an upward or vertical direction. In an alternate embodiment, the structure of the communication device itself may form the base.

Figure 2:
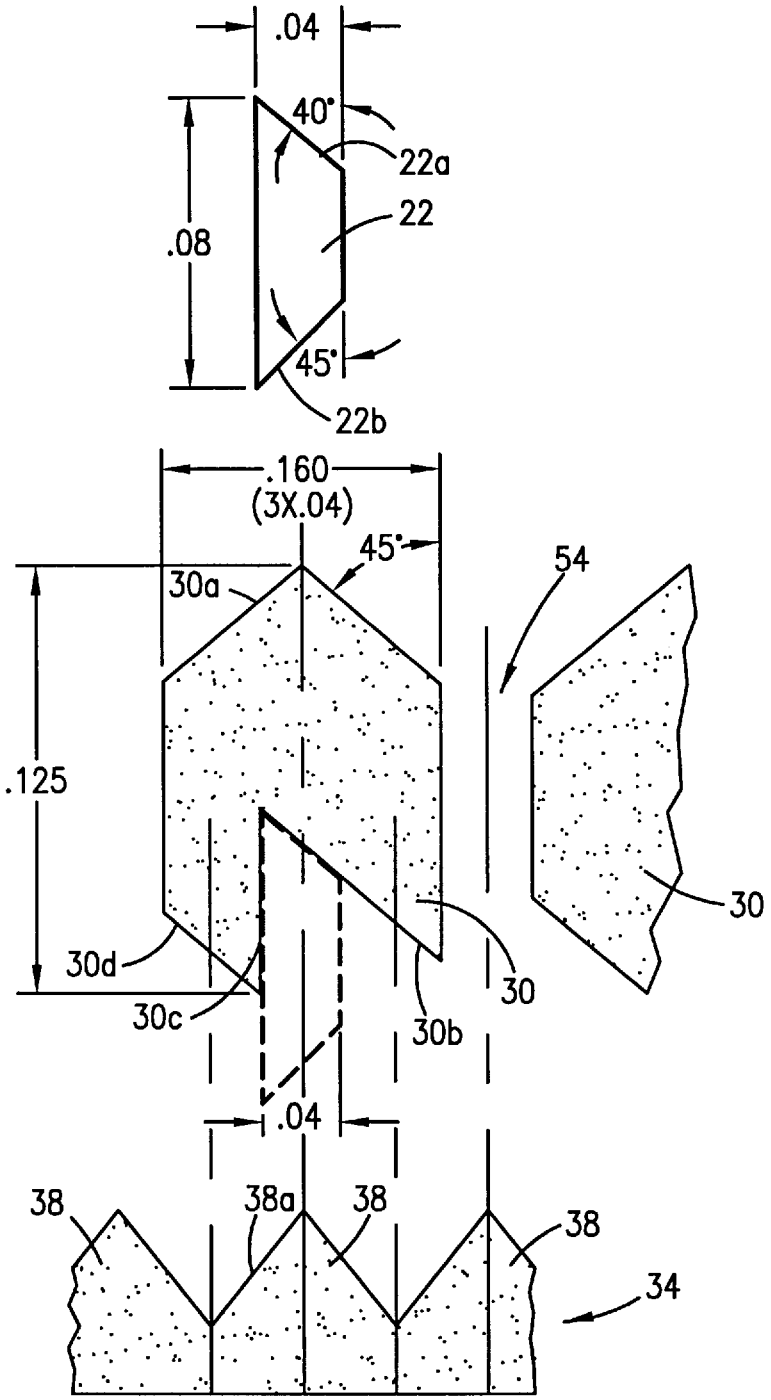
FIG. 2 is a cutaway view of a detent, a detent guide, and a plurality of biasing teeth according to a preferred embodiment of the invention.

FIG. 2 is a cutaway view of a detent 22, of two detent guides 30, and of a plurality of biasing teeth 38 according to a preferred embodiment of the invention. Referring now to FIG. 2, a detent 22, a guide 30 and a plurality of biasing teeth 38 are shown in a cutaway view so that the interaction of the three types of structures may better be understood.

The detent 22 includes a top surface 22*a* and a bottom surface 22*b* for interacting with guide 30 and with teeth 38. The top surface 22*a* is formed at a 40 degree angle relative to a vertical axis. The bottom surface 22*b* is formed at a 135 degree angle relative to the same vertical axis. While the angles are those of the preferred embodiment, the invention is not limited to forming top and bottom surfaces 22*a* and 22*b* at these angles. Guide 30 includes a top surface 30*a* and bottom surface 30*b* for interacting with bottom surface 22*b* and top surface 22*a* of detent 22, respectively. Guide 30 also includes a vertical surface 30*c* which, with bottom surface 30*b*, forms an undercut portion to matingly engage detent 22.

The teeth ring 34 includes a plurality of surfaces 38*a* on the plurality of teeth 38. The surfaces 38*a* are for interacting with bottom surface 22*b* of each of the detents 22 of detent member 18. The plurality of guides 30 are formed within fixed detent member 26 of FIG. 1 and are circumferentially placed apart to create a plurality of channels 54. The channels 54 are formed to be wide enough to allow detent 22 to pass therethrough. In the preferred embodiment, channel 54 is only slightly wider than detent 22 thereby causing detent 22 to pass snugly therethrough. The actual dimensions of the various elements shown in FIG. 2 are the dimensions of a preferred embodiment of the invention and are provided to facilitate the practice of the invention. The invention is not, however, limited to the dimensions shown.

Figure 3:
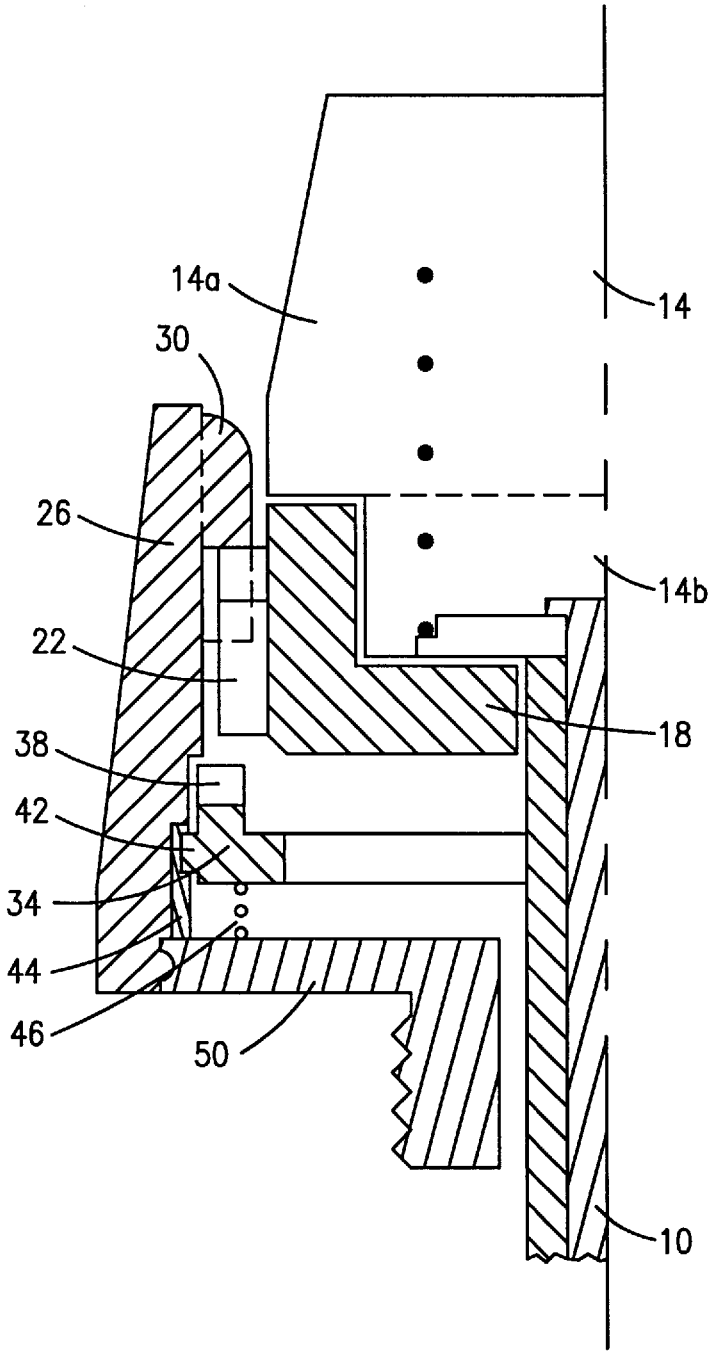
FIG. 3 is a cutaway view of the antenna and latching mechanism according to a preferred embodiment of the invention.

FIG. 3 is a cutaway view of the antenna and latching mechanism according to a preferred embodiment of the invention. Referring now to FIG. 3, each of the aforementioned helix 14 with the upper and lower portions 14*a* and 14*b*, respectively, the movable detent member 18, a detent 22, the fixed detent member 26, a guide 30, the teeth ring 34, a tooth 38, the notch 42, the biasing device 46 and the base 50 are shown. Additionally, a channel 44 which is for matingly engaging notch 42 is shown. It is the channel 44 which keeps the teeth ring 34 from rotating about the vertical axis. Because channel 44 is vertically oriented, notch 42 is only allowed to move in a vertical direction. Accordingly, teeth ring 34 may only move in a vertical direction.

FIGS. 4 through 18 are exploded cutaway views of the latching mechanism which demonstrate the operational sequence of events as the latching mechanism latches and unlatches the antenna. For each of FIGS. 4 through 18, there is shown a helix 14 with a movable detent member 18 rotatably connected thereto, a plurality of detents 22 formed on the surface of detent member 18 and a plurality of guides 30, and a teeth ring 34 with a plurality of teeth 38. Additionally, a whip antenna 10 and driving device 58 to urge the whip antenna in an upward direction are shown. The relative placement of these elements differs for each of the FIGS. 4 through 18. As shown in FIGS. 4–18, the guides 30 are shown in an exploded manner without any supporting structure. It is understood that these guides 30 are formed within an inner surface of fixed detent member 26. Fixed detent member 26 is not shown in FIGS. 4–18 so as to allow a clear demonstration of the interaction between the detents 22 with the guides 30 and the teeth 38 of teeth ring 34.

Figure 6:
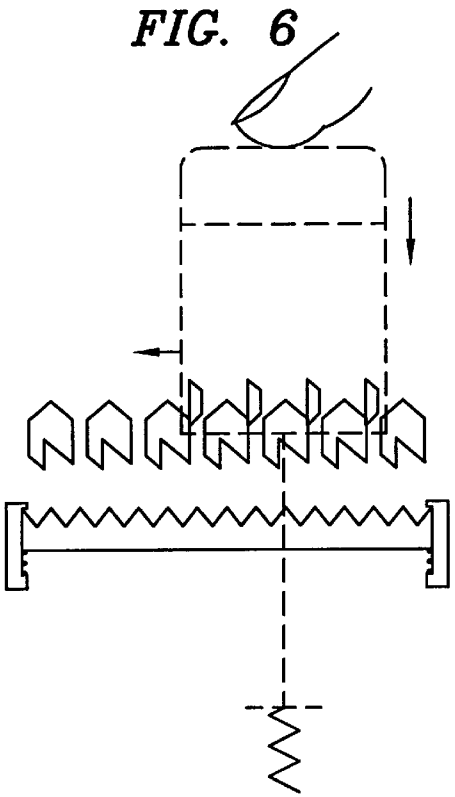
FIGS. 4 through 18 are cutaway views of the latching mechanism which demonstrate the operational sequence of events as the latching mechanism latches and unlatches the antenna.
Figure 5:
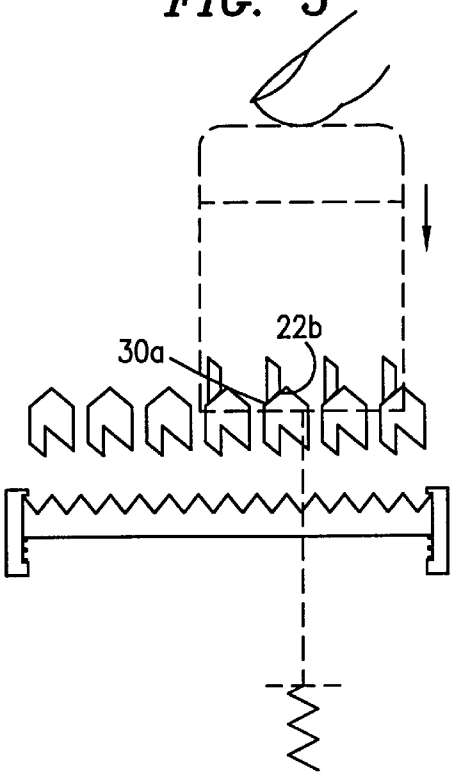
Figure 4:
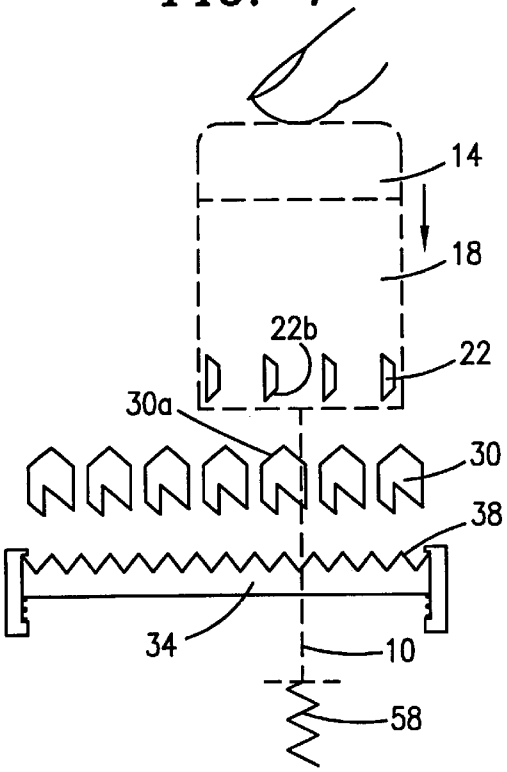
Figure 9:
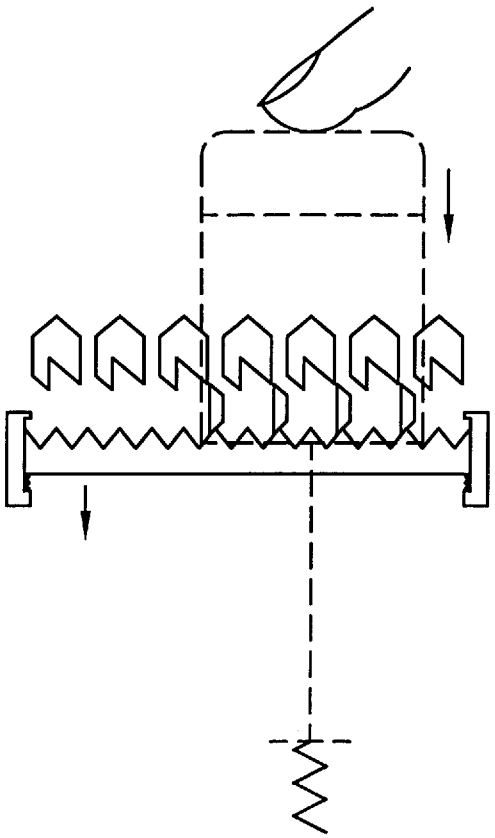

Referring now to FIG. 4, a finger is beginning to urge helix 14 down toward teeth ring 34. In FIG. 4, none of the elements are shown to be mechanically interacting with each other. Referring now to FIG. 5, however, it may be seen that helix 14 has been urged downwardly to the point that the bottom surfaces 22*b* of detents 22 are contacting the upper surfaces 30*a* of guides 30. Referring now to FIG. 6, it may be seen that the continuing downward urging by the finger causes the rotatably movable detent member 18 to rotate in a clockwise direction so as to allow the helix to continue to travel downward. The movable detent member 18 continues to rotate as it and the helix 14 travel in a downward direction until bottom surface 22*b* and upper surface 30*a* are no longer engaged or interacting. At this point, each of the detents 22 are lined up over channel 54.

Figure 8:
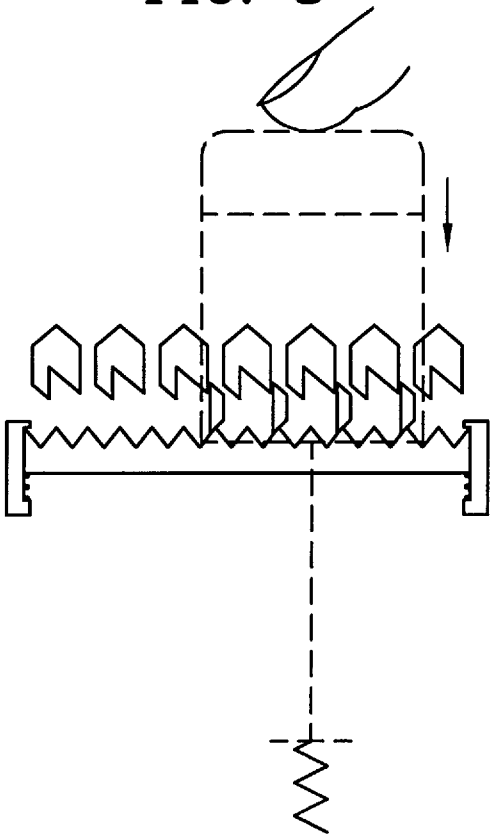
Figure 7:
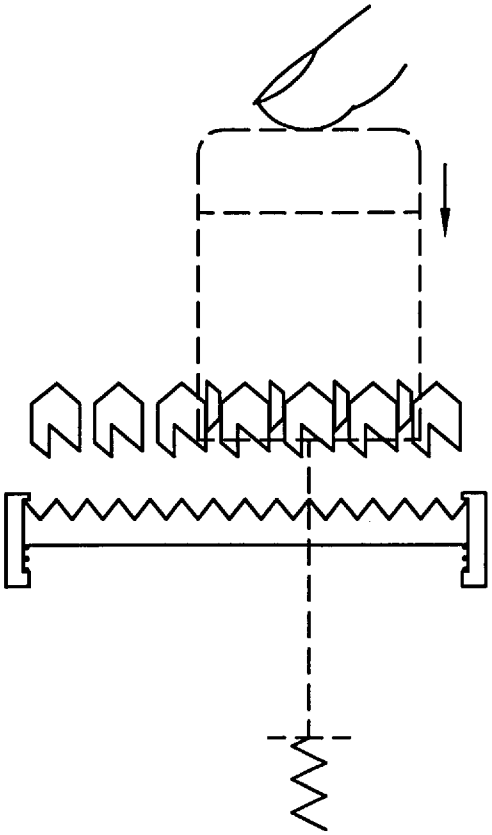

Referring now to FIG. 7, it may be seen that the detents 22 are within the channels 54. Once each of the detents 22 are lined up over channel 54, they will travel down the channel as the finger urges helix 14 in a downward direction. As is shown in FIG. 8, the helix 14 will continue to travel in a downward direction until the detents 22 contact the teeth 38 of teeth ring 34. The detents 22 engage the teeth 38 while still partially retained within the channels 54 between guide surfaces 30, and compress the biasing teeth ring 34 and biasing device 46.

Figure 10:
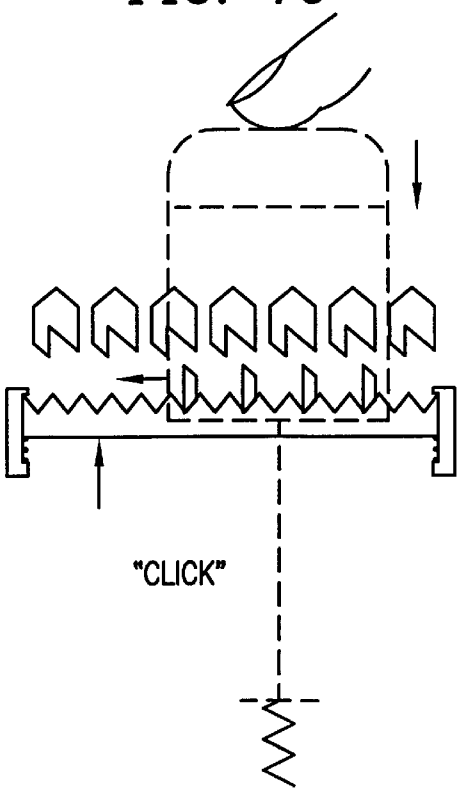

Once the detents 22 have compressed the teeth ring 34 and biasing device 46 to a distance such that the detents 22 clear the guide surfaces 30 (FIG. 9), the biasing teeth ring 34 is forced upward by biasing device 46, rotating the movable detent assembly 18 and producing an audible "click" sound (FIG. 10). A small amount of overtravel of the biasing teeth ring 34 is present after the click and rotation of the movable detents 18 and the helix assembly 14; the helix 14 and movable detent assembly 18 then reaches the maximum downward travel point. At this point the downward urging from the finger stops, and the helix 14 and rod 10 are allowed to move upward, being urged upward by driving device 58.

Figure 12:
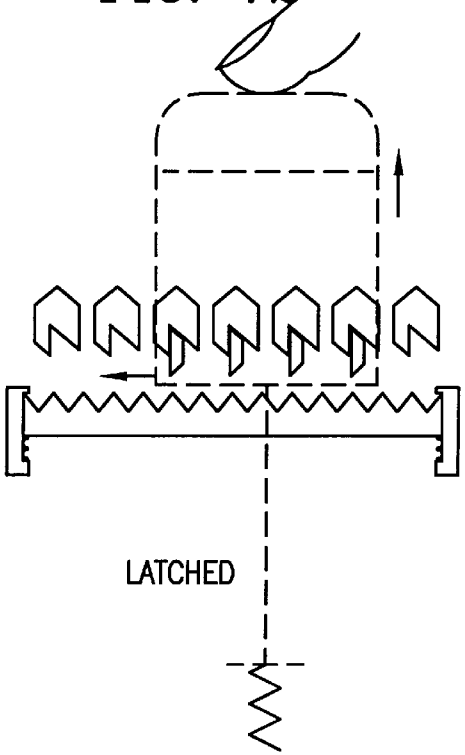
Figure 11:
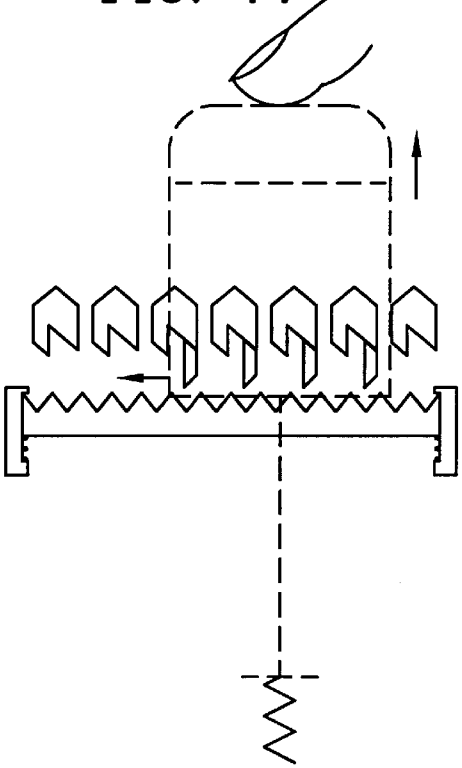

As is shown in FIG. 12, the movable detent member will continue to rotate in a clockwise direction as the helix 14 travels in a upward direction until each of the detents 22 reaches an undercut portion of an inner area formed within the guides 30. At this point, the antenna is latched because the guides 30 will hold the helix 14 and antenna in place until further action is taken.

Figure 15:
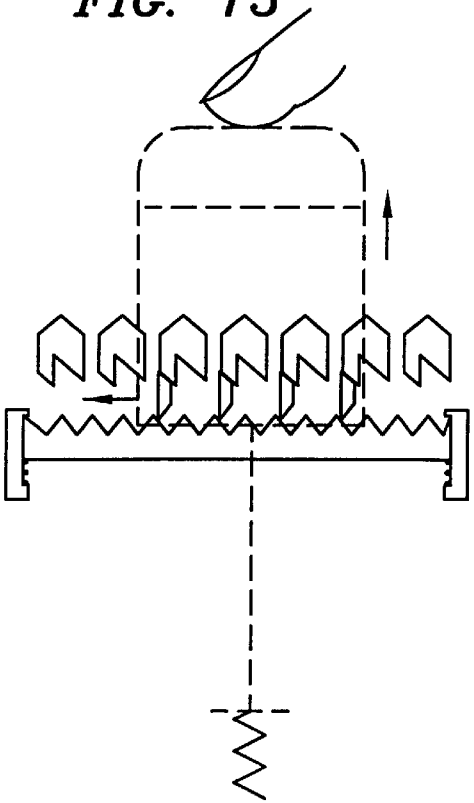
Figure 14:
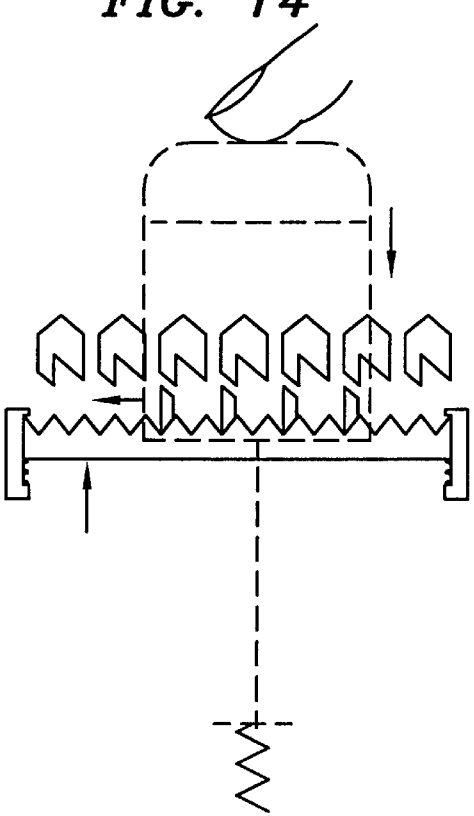
Figure 13:
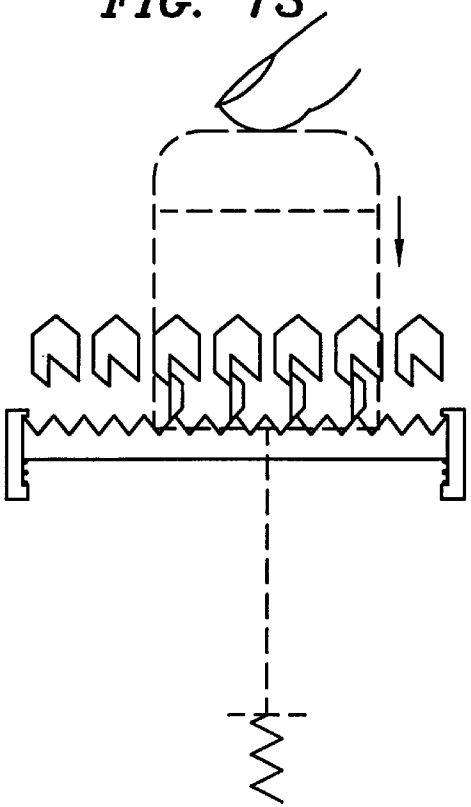
Figure 18:
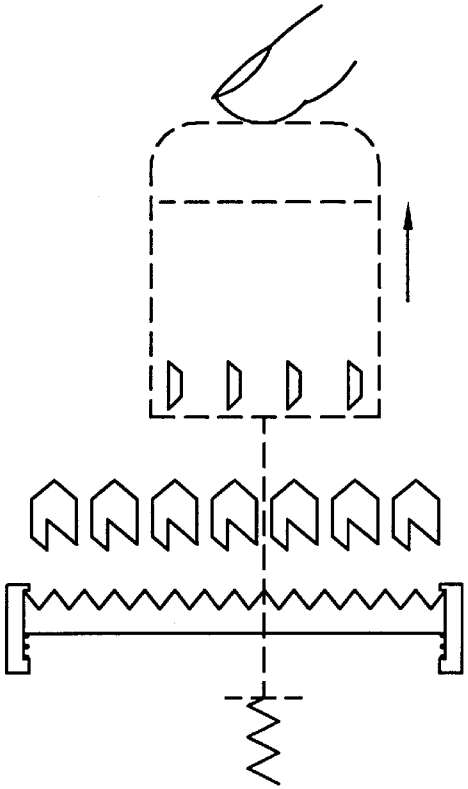
Figure 17:
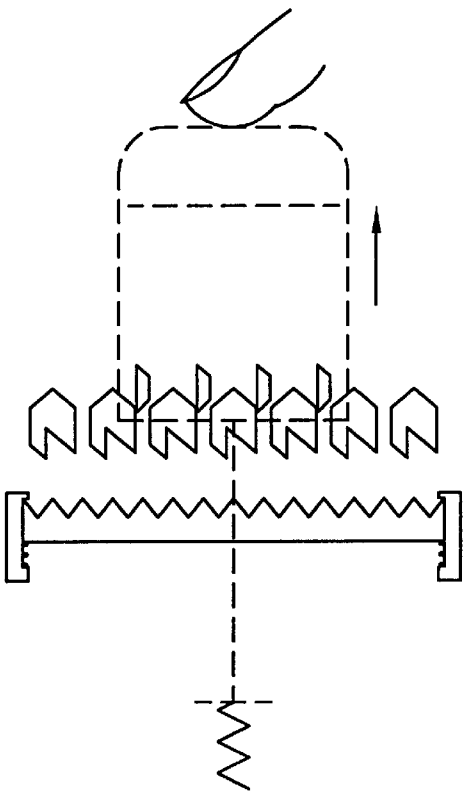
Figure 16:
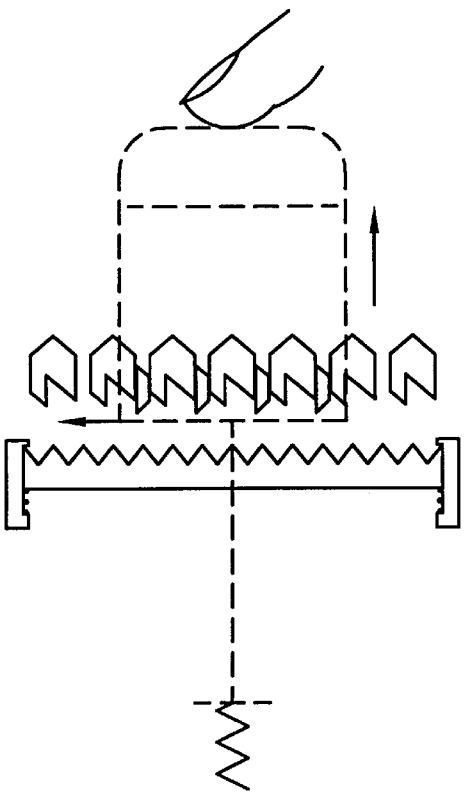

Referring now to FIG. 13, helix 14 will travel in a downward direction once the finger starts to urge the antenna in a downward direction until the detents 22 engage the teeth 38 while still partially retained within the channels between guide surfaces 30, and compress the biasing teeth ring 34 and biasing device 36. Once the detents 22 have compressed the teeth ring 34 and biasing device 46 to a distance such that the detents 22 clear the side surfaces of guide surfaces 30, the biasing teeth ring 34 is forced upward by biasing device 46, rotating the movable detent assembly 18 and producing an audible "click" sound (FIG. 14); at this point the antenna 10 and helix 14 assembly are unlatched. A small amount of overtravel of the biasing teeth ring 34 is present after the click and rotation of the movable detents 18 and the helix assembly 14; the helix 14 and movable detent assembly 18 then reach maximum downward travel. Accordingly, as is shown in FIG. 15, once the finger ceases to urge helix 14 in a downward direction, the driving device 58 will urge the antenna and the helix 14 in an upward direction until the upper surfaces 22*a* of the detents 22 reach the surfaces 30*d* of guide 30. At this point, movable member 18 rotates in a clockwise direction as helix 14 travels upward until the detents 22 are aligned with the channels 54 as is shown in FIG. 16. Thereafter, driving device 58 urges the antenna upward as the detents 22 travel through the channels 54 until the movable member 18 are clear of the guides 30 and the antenna is extended as shown in FIGS. 17 and 18.

As may be seen in the foregoing Detailed Description of the Invention, the disclosed push-push type of latch mechanism is simple, does not require additional buttons or springs, and facilitates the incorporation of a push-push type latch mechanism in a portable communication device. Accordingly, the disclosed invention will facilitate the implementation of the antenna system which is convenient.

Although an embodiment of the method and apparatus of the present invention has been illustrated in the accompanying Drawings and described in the foregoing Detailed Description, it is understood that the invention is not limited to the embodiment disclosed, and is capable of numerous rearrangements, modifications and substitutions without departing from the spirit of the invention as set forth and defined by the following claims.

What is claimed is:

1. A latch mechanism for latching an antenna of a communication device, the latch mechanism comprising:

a rotatable detent member fixedly attached to the antenna;

a fixed detent member permanently attached to the communication device, the fixed detent member having an inner surface forming a passageway to pass the antenna and the rotatable detent member therethrough;

a plurality of latch detents formed upon the outer surface of the rotatable detent member;

a plurality of guide detents formed within the inner surface of the fixed detent member, the guide detents for guiding and for latching the latch detents;

a teeth ring for engaging the latch detents to cause the rotatable detent member to rotate into and out of a latched position; and biasing means to urge the antenna in an outward direction with respect to the communication device.

2. The latch mechanism of claim 1 wherein the biasing means comprises a spring.

3. The latch mechanism of claim 1 wherein the biasing means comprises a motor for driving the antenna in an outward direction.

4. The latch mechanism of claim 1 further including a teeth ring biasing means for urging the teeth ring from a base toward the guide detents.

5. The latch mechanism of claim 3 wherein the teeth ring includes a notch and wherein the fixed detent member includes a channel for slidingly allowing the key ring to move in an axial direction.

6. A latch mechanism for latching an antenna of a communication device, comprising:

a fixed detent member rigidly attached to the communication device, the fixed detent member having an inner surface and forming a passageway to allow the antenna to pass therethrough;

a plurality of guide detents, each having at least one upper guide surface and at least one lower guide surface formed thereon, said plurality of guide detents being formed upon the inner surface of said fixed detent member, the guide detents being spaced apart to create a plurality of guide channels, each of said plurality of guide detents also forming a latch undercut portion;

a rotatable detent member permanently attached to the communication device antenna, said rotatable detent member formed to pass through said fixed detent member; and a plurality of latch detents formed upon an outer surface of said rotatable detent member, said plurality of latch detents formed to matingly engage the upper and lower guide surfaces of the guide detents and to pass through the plurality of guide channels wherein the rotatable detent member rotates as the plurality of guide detents engage the upper and lower guide surfaces of the latch detents as the antenna is urged either inward into the communication device by a finger or outward by a spring or motorized mechanism for urging the antenna.

7. The latch mechanism of claim 6 further including a teeth ring biasing means for urging the teeth ring from a base toward the guide detents.

8. The latch mechanism of claim 7 including a channel for slidingly allowing the key ring to move in an axial direction.

9. A latch mechanism for latching an antenna of a communication device, the antenna having a helical portion with a lower end at a top end of the antenna, comprising:

a first detent member having an upper end, the upper end being rotatably attached, to the lower end of the helical portion of the antenna;

a plurality of detents circumferentially formed about said detent member, each of said plurality of detents having a lower sloping surface;

a second detent member rigidly mounted upon the communication device, the second detent member including a plurality of guide surfaces integrally formed within an inner surface of said second detent member, the plurality of guide surfaces for mating with and engaging said plurality of detents;

a teeth ring having an upper portion formed in a saw tooth pattern to slidingly engage the lower sloping surface of each of said plurality of detents, said teeth ring being axially movable and also being rotationally fixed; and means for biasing and urging the teeth ring in an axial direction toward the first detent member.

10. The latch mechanism of claim 9 wherein the means for biasing and urging includes a spring.

11. The latch mechanism of claim 9 wherein the means for biasing and urging includes a motor.

* * * * *